US011378296B2

(12) United States Patent
Liu et al.

(10) Patent No.: US 11,378,296 B2
(45) Date of Patent: Jul. 5, 2022

(54) MULTI-SPLIT AIR CONDITIONER AND CONTROL METHOD THEREOF

(71) Applicants: QINGDAO HAIER AIR-CONDITIONING ELECTRONIC CO., LTD, Qingdao (CN); HAIER SMART HOME CO., LTD, Qingdao (CN)

(72) Inventors: Jingsheng Liu, Qingdao (CN); Qiang Song, Qingdao (CN); Tao Ren, Shandong (CN); Qingliang Meng, Qingdao (CN); Yinyin Li, Qingdao (CN); Jiangbin Liu, Qingdao (CN); Defang Guo, Qingdao (CN); Xueyan Tan, Qingdao (CN)

(73) Assignees: QINGDAO HAIER AIR-CONDITIONING ELECTRONIC CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 106 days.

(21) Appl. No.: 16/761,476

(22) PCT Filed: May 28, 2019

(86) PCT No.: PCT/CN2019/088709
§ 371 (c)(1),
(2) Date: May 4, 2020

(87) PCT Pub. No.: WO2020/143155
PCT Pub. Date: Jul. 16, 2020

(65) Prior Publication Data

US 2021/0262690 A1 Aug. 26, 2021

(30) Foreign Application Priority Data

Jan. 10, 2019 (CN) ..... 201910023902.X

(51) Int. Cl.
*F24F 11/64* (2018.01)
*F24F 11/84* (2018.01)
*F24F 1/14* (2011.01)

(52) U.S. Cl.
CPC ..... *F24F 11/64* (2018.01); *F24F 1/14* (2013.01); *F24F 11/84* (2018.01)

(58) Field of Classification Search
CPC ..... F25B 2600/25; F25B 2600/022; F25B 49/02; F25B 2313/0233; F25B 2313/0253; F24F 1/14; F24F 11/84; F24F 11/64
See application file for complete search history.

(56) References Cited

U.S. PATENT DOCUMENTS

2016/0370045 A1* 12/2016 Takenaka ..... F28D 1/0443

FOREIGN PATENT DOCUMENTS

CN 103574852 2/2014
CN 103574852 A * 2/2014
(Continued)

OTHER PUBLICATIONS

CN-109140826-A Translation (Year: 2019).*
(Continued)

*Primary Examiner* — Schyler S Sanks
(74) *Attorney, Agent, or Firm* — Calfee, Halter & Griswold LLP

(57) ABSTRACT

The present application discloses a multi-split air conditioner and a control method thereof. The multi-split air conditioner includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch. The control method includes: determining a current superheat degree of
(Continued)

the multi-split air conditioner; when the current superheat degree of the multi-split air conditioner deviates from a set target superheat degree, controlling and regulating the flow rate of the refrigerant flowing through the branch control valve; and controlling and regulating the flow rate of the refrigerant flowing through the air supplement control valve according to the flow rate of the refrigerant flowing through each of branch control valves.

10 Claims, 5 Drawing Sheets

(56) References Cited

FOREIGN PATENT DOCUMENTS

| | | | | | |
|---|---|---|---|---|---|
| CN | 106382701 | A | | 2/2017 | |
| CN | 206347775 | | | 7/2017 | |
| CN | 107477933 | | | 12/2017 | |
| CN | 107631525 | | | 1/2018 | |
| CN | 207299635 | U | | 5/2018 | |
| CN | 108105912 | A | | 6/2018 | |
| CN | 109140826 | A | * | 1/2019 | |
| JP | 2016020760 | | | 2/2016 | |
| WO | WO-2019052035 | A1 | * | 3/2019 | ..... F24F 11/30 |

OTHER PUBLICATIONS

CN-103574852-A Translation (Year: 2014).*
WO-2019052035-A1 Translation (Year: 2019).*
Office action from Chinese Application No. 201910023902.X dated Jan. 26, 2021.
International Search Report from International Application No. PCT/CN2019/088709 dated Sep. 27, 2019.

* cited by examiner

MULTI-SPLIT AIR CONDITIONER AND CONTROL METHOD THEREOF

CROSS-REFERENCE TO RELATED APPLICATIONS

This application is a U.S. National Phase of International Application No. PCT/CN2019/088709, filed May 28, 2019, which is based upon and claims priority to Chinese Patent Application No. 201910023902.X, filed Jan. 10, 2019, the entire contents of which are incorporated herein by reference.

TECHNICAL FIELD

The present disclosure relates to the field of air conditioner technologies, and more particularly, to a multi-split air conditioner and a control method thereof.

BACKGROUND

A multi-split air conditioner is an air conditioner in which two or more indoor units are connected to an outdoor unit through pipelines. The multi-split air conditioner is a kind of central air conditioners, the adaptability of the multi-split air conditioner is better than that of ordinary central air conditioner units, and a temperature regulation range of the multi-split air conditioner is wider.

At present, the multi-split air conditioner controls an opening degree of an air supplement circuit through a regulating valve, and then regulates a superheat degree, while the multi-split air conditioner has a plurality of parallel air supplement circuits.

During the implementation of the embodiments of the present disclosure, it is found that at least the following problems exist in related arts:

in the prior art, the superheat degree is regulated by separately controlling the opening degree of the air supplement circuit, and there is no associated control between each other, so that the heat exchange capability of a heat exchanger cannot be maximized.

SUMMARY

In order to have a basic understanding of some aspects of disclosed embodiments, a brief summary is given below. The summary is not a general comment, nor is it intended to identify key/important constituent elements or to describe the scope of protection of these embodiments, but serves as a preamble to the following detailed description.

The embodiments of the present disclosure provide a control method of a multi-split air conditioner.

In some embodiments, the multi-split air conditioner includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve, two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve is used for controlling the flow rate of the refrigerant supplementing the air to the compressor; wherein the control method includes:

determining a current superheat degree of the multi-split air conditioner;

when the current superheat degree of the multi-split air conditioner deviates from a set target superheat degree, controlling and regulating the flow rate of the refrigerant flowing through the branch control valve, so that the current superheat degree reaches the set target superheat degree; and controlling and regulating the flow rate of the refrigerant flowing through the air supplement control valve according to the flow rate of the refrigerant flowing through each of branch control valves.

The embodiments of the present disclosure provide a multi-split air conditioner.

In some embodiments, the multi-split air conditioner includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve, two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve is used for controlling the flow rate of the refrigerant supplementing the air to the compressor; and the multi-split air conditioner further includes a controller, used for:

determining a current superheat degree of the multi-split air conditioner;

when the current superheat degree of the multi-split air conditioner deviates from a set target superheat degree, controlling and regulating the flow rate of the refrigerant flowing through the branch control valve, so that the current superheat degree reaches the set target superheat degree; and controlling and regulating the flow rate of the refrigerant flowing through the air supplement control valve according to the flow rate of the refrigerant flowing through each of branch control valves.

The embodiments of the present disclosure provide an electronic device.

In some embodiments, the electronic device includes:

at least one processor; and a memory communicatively connected to the at least one processor; wherein, the memory stores instructions that can be executed by the at least one processor, and when the instructions are executed by the at least one processor, the at least one processor performs the above-mentioned control method of the multi-split air conditioner.

The embodiments of the present disclosure provide a computer readable storage medium.

In some embodiments, the computer readable storage medium stores computer executable instructions, and the computer executable instructions are configured to execute the above-mentioned control method of the multi-split air conditioner.

The embodiments of the present disclosure provide a computer program product.

In some embodiments, the computer program product includes a computer program stored on a computer readable storage medium, the computer program includes program instructions, and when the program instructions are executed by a computer, the computer performs the above-mentioned control method of the multi-split air conditioner.

The above general description and the following description are exemplary and explanatory only and are not intended to limit the present application.

BRIEF DESCRIPTION OF THE DRAWINGS

One or more embodiments are exemplarily described by corresponding accompanying drawings. These exemplary descriptions and drawings do not limit the embodiments. Elements with same reference numerals in the drawings are shown as similar elements. The drawings do not constitute a scale limitation, and in which.

DESCRIPTION OF REFERENCE SIGNS

1: multi-split air conditioner; 121: first sensor; 122: second sensor; 13: controller; 14: air supplement control valve.

DETAILED DESCRIPTION

To provide a more detailed understanding of features and technical contents of embodiments of the present disclosure, implementation of the embodiments of the present disclosure is described below in detail in conjunction with the drawings. The drawings are provided for reference only and are not intended to limit the embodiments of the present disclosure. In the following technical description, for convenience of explanation, various details are used to provide a full understanding of the disclosed embodiments. However, in the absence of these details, one or more embodiments may still be implemented. In other cases, well-known structures and devices may be shown simplistically in order to simplify the drawings.

Figure 1:
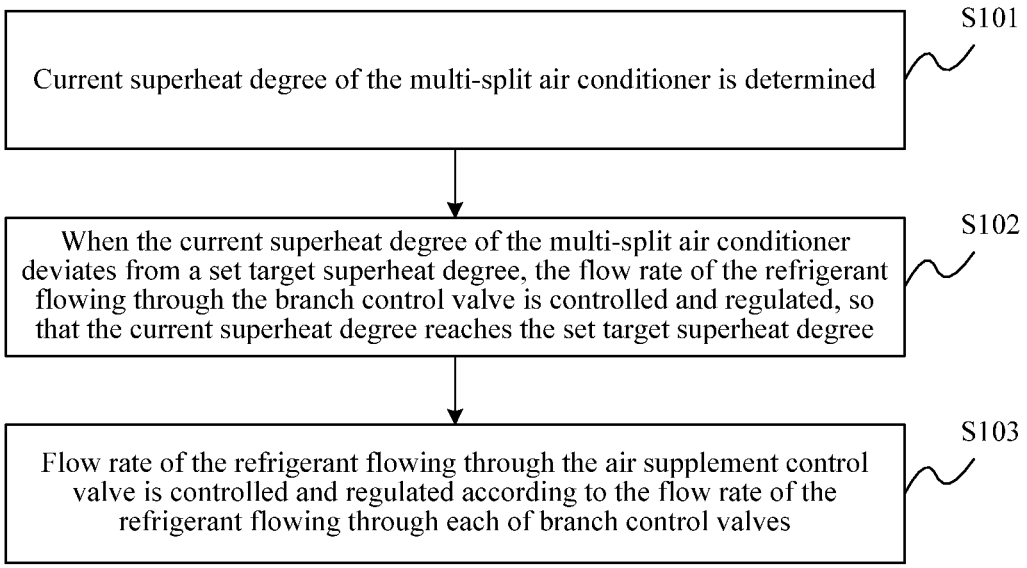
FIG. 1 is a flowchart illustrating a control method of an air conditioner according to an embodiment of the present disclosure.

FIG. 1 is a flowchart illustrating a control method of an air conditioner according to an exemplary embodiment of the present disclosure.

As shown in FIG. 1, the present disclosure provides a control method of an air conditioner. The control method can correlate a control of an air supplement control valve 14 of each refrigerant flow branch of a multi-split air conditioner 1, and regulate a superheat degree by controlling an opening degree of each air supplement control valve 14, and thus a heat exchange performance is improved and a heat exchange capability of the multi-split air conditioner 1 is maximized. Specifically, the control method mainly includes the following steps.

S101, a current superheat degree of the multi-split air conditioner 1 is determined.

Optionally, the superheat degree refers to a difference between a superheat temperature and a saturation temperature of the refrigerant at a same evaporation pressure in a refrigeration cycle. The multi-split air conditioner 1 includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve 14, wherein two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve 14 is used for controlling the flow rate of the refrigerant supplementing the air to the compressor.

Optionally, temperature sensors can be provided at two ends of the pipelines in the multi-split air conditioner 1 to detect temperatures at two ends of the pipelines, and thus the current superheat degree of the multi-split air conditioner 1 is obtained.

S102, when the current superheat degree of the multi-split air conditioner deviates from a set target superheat degree, the flow rate of the refrigerant flowing through the branch control valve is controlled and regulated, so that the current superheat degree reaches the set target superheat degree.

Optionally, the air conditioner is provided with a controller 13, and the target superheat degree can be preset. The target superheat degree is not limited here, and the target superheat degree may be one degree. When the current superheat degree measured by the multi-split air conditioner 1 is greater than or less than one degree, the controller 13 can control and regulate the flow rate of the refrigerant flowing through the branch control valve. By changing the flow rate of the refrigerant flowing through each branch, the temperatures at two ends of the pipelines are regulated, so that the current superheat degree is regulated to reach the set target superheat degree.

S103, the flow rate of the refrigerant flowing through the air supplement control valve 14 is controlled and regulated according to the flow rate of the refrigerant flowing through each of branch control valves.

Optionally, the air conditioner is provided with the controller 13 that can control the air supplement control valve 14. The air supplement control valve 14 can control the flow rate of the refrigerant, each of the branch control valves controls the flow rate of the refrigerant flowing through the branch, and each of the branch control valves 14 has a correlation relationship.

Figure 2:
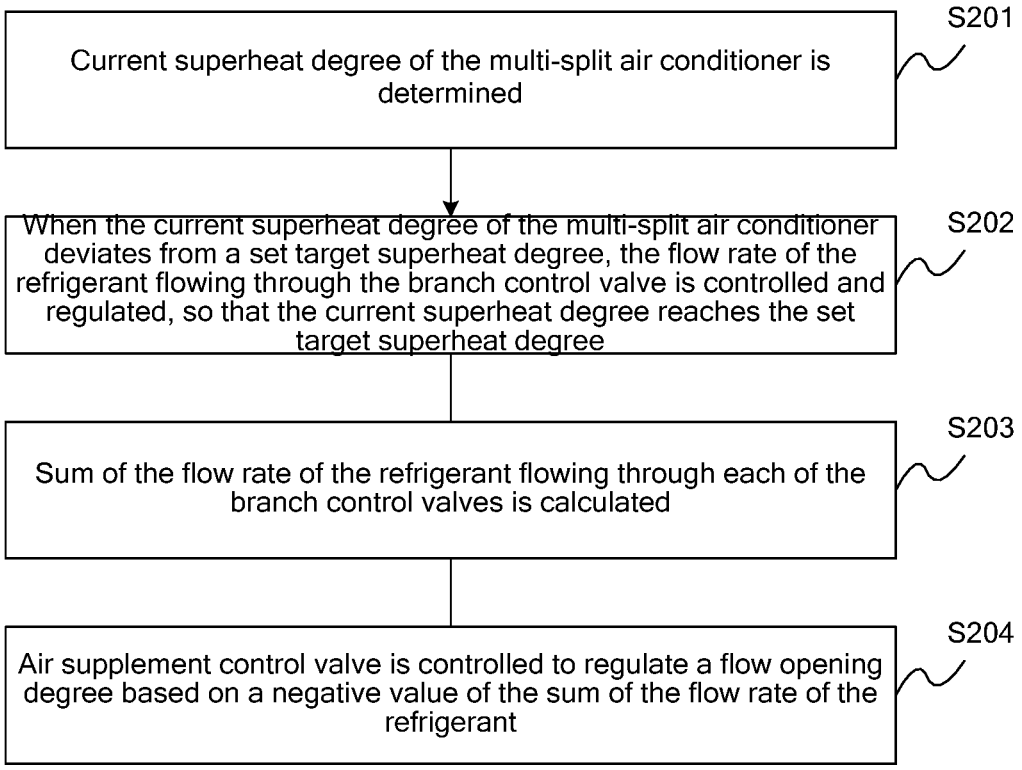
FIG. 2 is a flowchart illustrating a control method of an air conditioner according to an embodiment of the present disclosure.

FIG. 2 is a flowchart illustrating a control method of an air conditioner according to another exemplary embodiment of the present disclosure.

As shown in FIG. 2, the present disclosure further provides a control method of the air conditioner. The control method can also correlate a control of an air supplement control valve 14 of each refrigerant flow branch of a multi-split air conditioner 1, and regulate a superheat degree by controlling an opening degree of each air supplement control valve 14, and thus a heat exchange performance is improved and a heat exchange capability of the multi-split air conditioner 1 is maximized. Specifically, the control method mainly includes the following steps.

S201, a current superheat degree of the multi-split air conditioner 1 is determined.

Optionally, the superheat degree refers to a difference between a superheat temperature and a saturation temperature of the refrigerant at a same evaporation pressure in a refrigeration cycle. The multi-split air conditioner 1 includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve 14, wherein two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve 14 is used for controlling the flow rate of the refrigerant supplementing the air to the compressor.

Optionally, temperature sensors can be provided at two ends of the pipelines in the multi-split air conditioner 1 to detect temperatures at two ends of the pipelines, and thus the current superheat degree of the multi-split air conditioner 1 is obtained.

S202, when the current superheat degree of the multi-split air conditioner deviates from a set target superheat degree, the flow rate of the refrigerant flowing through the branch control valve is controlled and regulated, so that the current superheat degree reaches the set target superheat degree.

Optionally, the air conditioner is provided with a controller 13, and the target superheat degree can be preset. The target superheat degree is not limited here, and the target superheat degree may be one degree. When the current superheat degree measured by the multi-split air conditioner 1 is greater than or less than one degree, the controller 13 can control and regulate the flow rate of the refrigerant flowing through the branch control valve. By changing the flow rate of the refrigerant flowing through each branch, the temperatures at two ends of the pipelines are regulated, so that the current superheat degree is regulated to reach the set target superheat degree.

S203, a sum of the flow rate of the refrigerant flowing through each of the branch control valves is calculated.

Optionally, the multi-split air conditioner 1 is provided with the controller 13 that can be used for calculating the sum of the flow rate of the refrigerant flowing through each of the branch control valves, and regulating the control of the air supplement control valve 14 on the flow rate of the refrigerant according to the flow rate of the refrigerant flowing through each of the branch control valves. When the sum of the flow rate of the refrigerant flowing through each of the branch control valves is less than a preset parameter of the flow rate of the refrigerant, the controller 13 controls the air supplement control valve 14 to be opened; and when the sum of the flow rate of the refrigerant flowing through each of the branch control valves is greater than or equal to the preset parameter of the flow rate of the refrigerant, the controller 13 controls the air supplement control valve 14 to be closed.

S204, the air supplement control valve 14 is controlled to regulate a flow opening degree based on a negative value of the sum of the flow rate of the refrigerant.

Optionally, the multi-split air conditioner 1 is provided with the controller 13 that can control the flow opening degree of the air supplement control valve 14 according to the negative value of the sum of the flow rate of the refrigerant flowing through each of the branch control valves. When the sum of the flow rate of the refrigerant flowing through each of the branch control valves is less than the preset parameter of the flow rate of the refrigerant, the controller 13 controls the air supplement control valve 14 to be opened; and when the sum of the flow rate of the refrigerant flowing through each of the branch control valves is greater than or equal to the preset parameter of the flow rate of the refrigerant, the controller 13 controls the air supplement control valve 14 to be closed.

Figure 3:
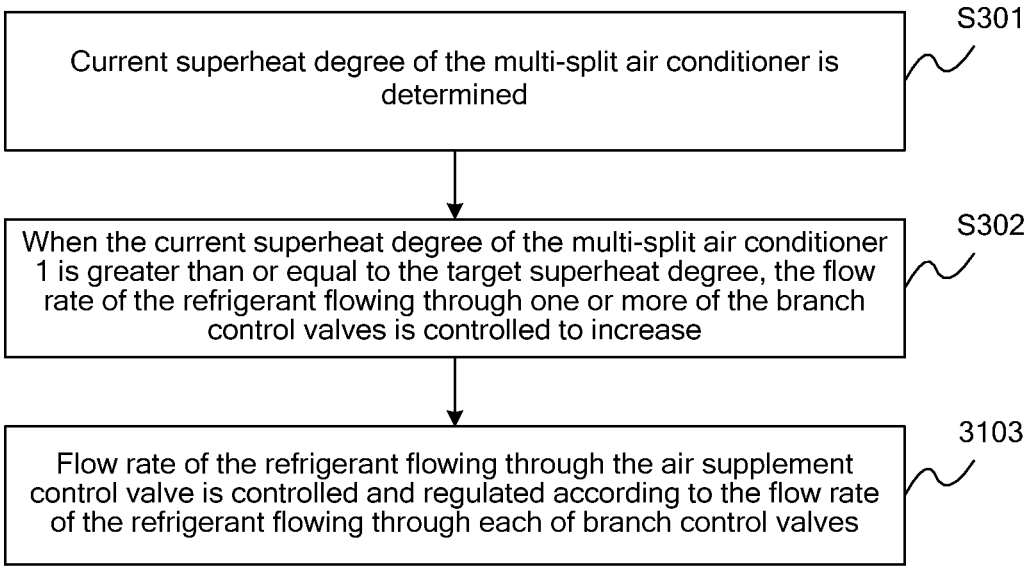
FIG. 3 is a flowchart illustrating a control method of an air conditioner according to an embodiment of the present disclosure.

FIG. 3 is a flowchart illustrating a control method of an air conditioner according to another exemplary embodiment of the present disclosure.

As shown in FIG. 3, the present disclosure further provides a control method of the air conditioner. The control method can also correlate a control of an air supplement control valve 14 of each refrigerant flow branch of a multi-split air conditioner 1, and regulate a superheat degree by controlling an opening degree of each air supplement control valve 14, and thus a heat exchange performance is improved and a heat exchange capability of the multi-split air conditioner 1 is maximized. Specifically, the control method mainly includes the following steps.

S301, a current superheat degree of the multi-split air conditioner 1 is determined.

Optionally, the superheat degree refers to a difference between a superheat temperature and a saturation temperature of the refrigerant at a same evaporation pressure in a refrigeration cycle. The multi-split air conditioner 1 includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve 14, wherein two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve 14 is used for controlling the flow rate of the refrigerant supplementing the air to the compressor.

Optionally, temperature sensors can be provided at two ends of the pipelines in the multi-split air conditioner 1 to detect temperatures at two ends of the pipelines, and thus the current superheat degree of the multi-split air conditioner 1 is obtained.

S302, when the current superheat degree of the multi-split air conditioner 1 is greater than or equal to the target superheat degree, the flow rate of the refrigerant flowing through one or more of the branch control valves is controlled to increase.

Optionally, the multi-split air conditioner 1 can also be provided with a controller 13 that can directly connect to the control valve on each branch and can directly control the flow rate of the refrigerant flowing through each of the branch control valves. When the current superheat degree of the multi-split air conditioner 1 is greater than or equal to the target superheat degree, the controller 13 can directly control to increase the flow rate of the refrigerant flowing through one of the branch control valves.

Optionally, the multi-split air conditioner 1 can also be provided with the controller 13 that can directly connect to the control valve on each branch. When the current superheat degree of the multi-split air conditioner 1 is greater than or equal to the target superheat degree, the controller 13 can directly control to increase the flow rate of the refrigerant flowing through more than one of the branch control valves, the present disclose does not limit the branch control valves, and the branch control valves are connected in parallel, which is equivalent to a shunt effect of the flow rate of the refrigerant.

S303, the flow rate of the refrigerant flowing through the air supplement control valve 14 is controlled and regulated according to the flow rate of the refrigerant flowing through each of branch control valves.

Optionally, the air conditioner is provided with the controller 13 that can control the air supplement control valve 14. The air supplement control valve 14 can control the flow rate of the refrigerant, each of the branch control valves controls the flow rate of the refrigerant flowing through the branch, and each of the branch control valves 14 has a correlation relationship.

Figure 4:
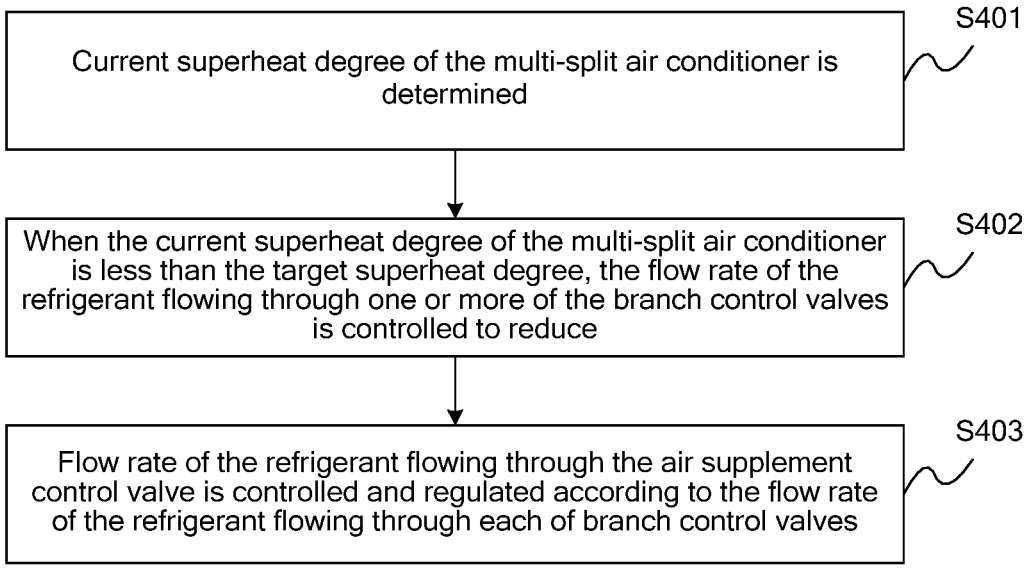
FIG. 4 a flowchart illustrating a control method of an air conditioner according to an embodiment of the present disclosure.

FIG. 4 is a flowchart illustrating a control method of an air conditioner according to another exemplary embodiment of the present disclosure.

As shown in FIG. 4, the present disclosure further provides a control method of the air conditioner. The control method can also correlate a control of an air supplement control valve 14 of each refrigerant flow branch of a multi-split air conditioner 1, and regulate a superheat degree by controlling an opening degree of each air supplement control valve 14, and thus a heat exchange performance is improved and a heat exchange capability of the multi-split air conditioner 1 is maximized. Specifically, the control method mainly includes the following steps.

S401, a current superheat degree of the multi-split air conditioner 1 is determined.

Optionally, the superheat degree refers to a difference between a superheat temperature and a saturation temperature of the refrigerant at a same evaporation pressure in a refrigeration cycle. The multi-split air conditioner 1 includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve 14, wherein two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve 14 is used for controlling the flow rate of the refrigerant supplementing the air to the compressor.

Optionally, temperature sensors can be provided at two ends of the pipelines in the multi-split air conditioner 1 to detect temperatures at two ends of the pipelines, and thus the current superheat degree of the multi-split air conditioner 1 is obtained.

S402, when the current superheat degree of the multi-split air conditioner 1 is less than the target superheat degree, the flow rate of the refrigerant flowing through one or more of the branch control valves is controlled to reduce.

Optionally, the multi-split air conditioner 1 can also be provided with a controller 13 that can directly connect to the control valve on each branch and can directly control the flow rate of the refrigerant flowing through each of the branch control valves. When the current superheat degree of the multi-split air conditioner 1 is less than the target superheat degree, the controller 13 can directly control to reduce the flow rate of the refrigerant flowing through one of the branch control valves.

Optionally, the multi-split air conditioner 1 can also be provided with the controller 13 that can directly connect to the control valve on each branch. When the current superheat degree of the multi-split air conditioner 1 is less than the target superheat degree, the controller 13 can directly control to increase the flow rate of the refrigerant flowing through more than one of the branch control valves, the present disclose does not limit the branch control valves, and the branch control valves are connected in parallel, which is equivalent to a shunt effect of the flow rate of the refrigerant.

S403, the flow rate of the refrigerant flowing through the air supplement control valve 14 is controlled and regulated according to the flow rate of the refrigerant flowing through each of branch control valves.

Optionally, the air conditioner is provided with the controller 13 that can control the air supplement control valve 14. The air supplement control valve 14 can control the flow rate of the refrigerant, each of the branch control valves controls the flow rate of the refrigerant flowing through the branch, and each of the branch control valves 14 has a correlation relationship.

Figure 5:
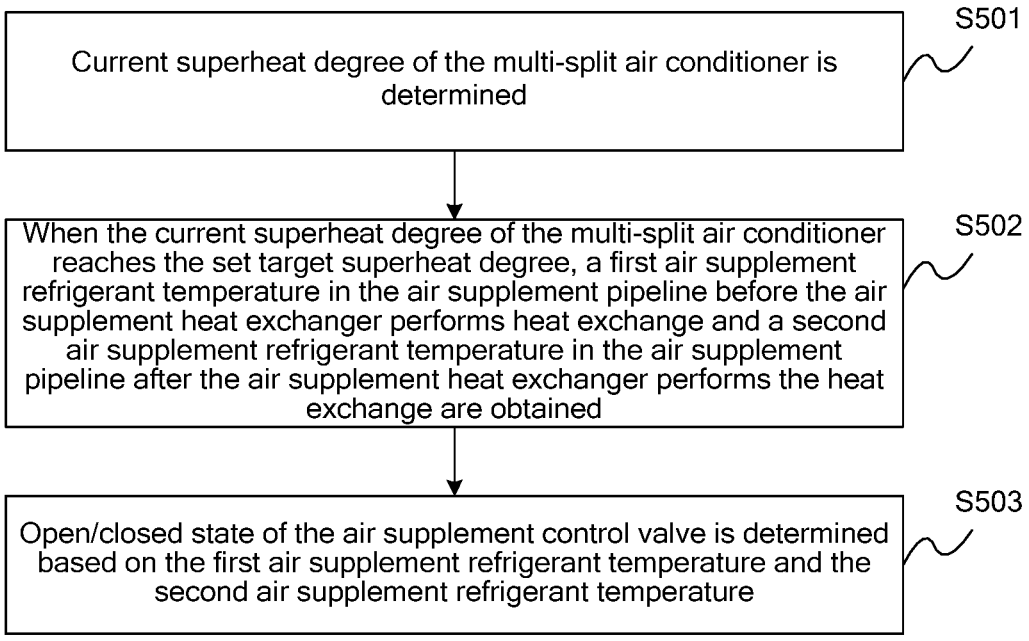
FIG. 5 is a flowchart illustrating a control method of an air conditioner according to an embodiment of the present disclosure.

FIG. 5 is a flowchart illustrating a control method of an air conditioner according to another exemplary embodiment of the present disclosure.

As shown in FIG. 5, the present disclosure further provides a control method of the air conditioner. The control method can also correlate a control of an air supplement control valve 14 of each refrigerant flow branch of a multi-split air conditioner 1, and regulate a superheat degree by controlling an opening degree of each air supplement control valve 14, and thus a heat exchange performance is improved and a heat exchange capability of the multi-split air conditioner 1 is maximized. Specifically, the control method mainly includes the following steps.

S501, a current superheat degree of the multi-split air conditioner 1 is determined.

Optionally, the superheat degree refers to a difference between a superheat temperature and a saturation temperature of the refrigerant at a same evaporation pressure in a refrigeration cycle. The multi-split air conditioner 1 includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve 14, wherein two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve 14 is used for controlling the flow rate of the refrigerant supplementing the air to the compressor.

Optionally, temperature sensors can be provided at two ends of the pipelines in the multi-split air conditioner 1 to detect temperatures at two ends of the pipelines, and thus the current superheat degree of the multi-split air conditioner 1 is obtained.

S502, when the current superheat degree of the multi-split air conditioner reaches the set target superheat degree, a first air supplement refrigerant temperature in the air supplement pipeline before the air supplement heat exchanger performs heat exchange and a second air supplement refrigerant temperature in the air supplement pipeline after the air supplement heat exchanger performs the heat exchange are obtained.

Optionally, the air conditioner further includes a first sensor 121 disposed on a pipeline segment in front of the air supplement heat exchanger on the air supplement pipeline and used for obtaining the first air supplement refrigerant temperature in the air supplement pipeline before the air supplement heat exchanger performs the heat exchange; and a second sensor 122 disposed on a pipeline segment behind the air supplement heat exchanger on the air supplement pipeline and used for obtaining the second air supplement refrigerant temperature in the air supplement pipeline after the air supplement heat exchanger performs the heat exchange. The air conditioner further includes a controller 13 for determining an open/closed state of the air supplement control valve 14 based on the first air supplement refrigerant temperature and the second air supplement refrigerant temperature when the current superheat degree of the multi-split air conditioner reaches the set target superheat degree.

S503, the open/closed state of the air supplement control valve 14 is determined based on the first air supplement refrigerant temperature and the second air supplement refrigerant temperature.

Optionally, the first air supplement refrigerant temperature can be a refrigerant temperature in the air supplement pipeline before the air supplement heat exchanger performs the heat exchange, and the second air supplement refrigerant temperature can be a refrigerant temperature in the air supplement pipeline after the air supplement heat exchanger performs the heat exchange. An absolute value of a difference between the first air supplement refrigerant temperature and the second air supplement refrigerant temperature is the superheat degree of the air supplement pipeline.

Optionally, when the absolute value of the difference between the first air supplement refrigerant temperature in the air supplement pipeline before the air supplement heat exchanger performs the heat exchange and the second air supplement refrigerant temperature in the air supplement pipeline after the air supplement heat exchanger performs the heat exchange is greater than a preset threshold range, it is indicated that the superheat degree is relatively high, the refrigerant circulation pipeline needs to be supplemented the air, and the controller 13 controls the air supplement control valve 14 to be opened.

Optionally, when the absolute value of the difference between the first air supplement refrigerant temperature in the air supplement pipeline before the air supplement heat exchanger performs the heat exchange and the second air supplement refrigerant temperature in the air supplement pipeline after the air supplement heat exchanger performs the heat exchange is less than the preset threshold range, it is indicated that the superheat degree is relatively low, the refrigerant circulation pipeline does not need to be supplemented the air, and the controller 13 controls the air supplement control valve 14 to be closed.

Figure 6:
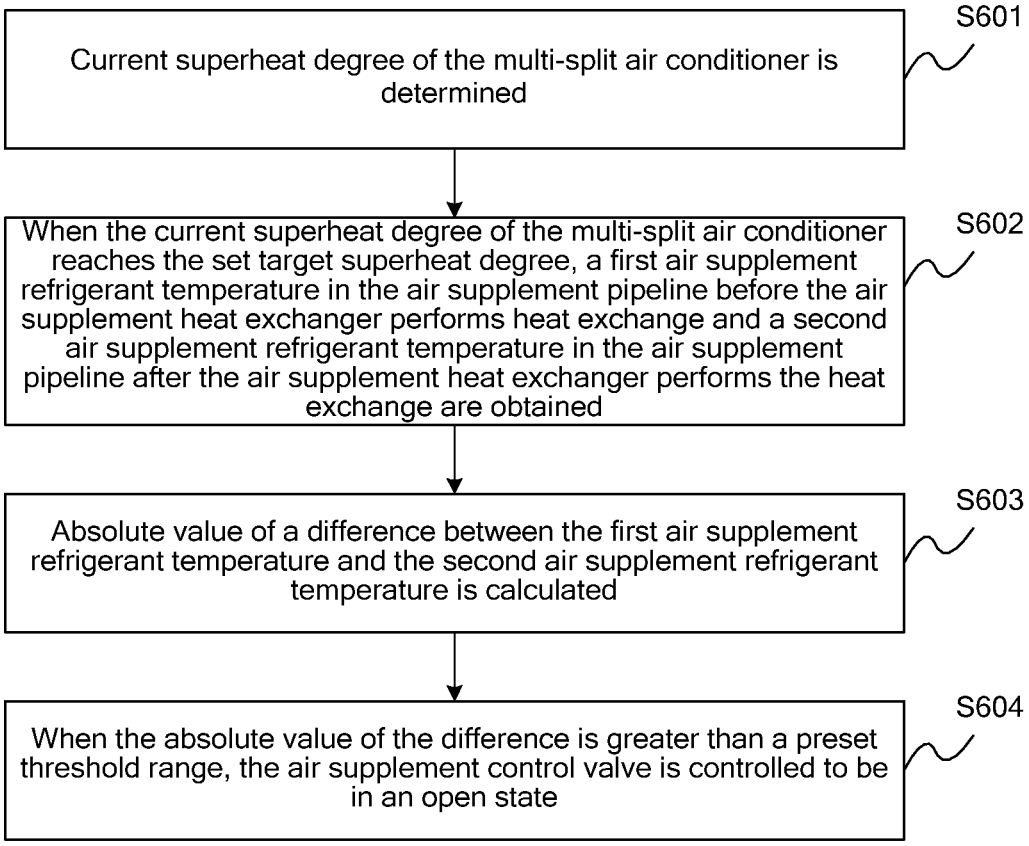
FIG. 6 is a flowchart illustrating a control method of an air conditioner according to an embodiment of the present disclosure.

FIG. 6 is a flowchart illustrating a control method of an air conditioner according to another exemplary embodiment of the present disclosure.

As shown in FIG. 6, the present disclosure further provides a control method of the air conditioner. The control method can also correlate a control of an air supplement control valve 14 of each refrigerant flow branch of a multi-split air conditioner 1, and regulate a superheat degree by controlling an opening degree of each air supplement control valve 14, and thus a heat exchange performance is improved and a heat exchange capability of the multi-split air conditioner 1 is maximized. Specifically, the control method mainly includes the following steps.

S601, a current superheat degree of the multi-split air conditioner 1 is determined.

Optionally, the superheat degree refers to a difference between a superheat temperature and a saturation temperature of the refrigerant at a same evaporation pressure in a refrigeration cycle. The multi-split air conditioner 1 includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve 14, wherein two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve 14 is used for controlling the flow rate of the refrigerant supplementing the air to the compressor.

Optionally, temperature sensors can be provided at two ends of the pipelines in the multi-split air conditioner 1 to detect temperatures at two ends of the pipelines, and thus the current superheat degree of the multi-split air conditioner 1 is obtained.

S602, when the current superheat degree of the multi-split air conditioner reaches the set target superheat degree, a first air supplement refrigerant temperature in the air supplement pipeline before the air supplement heat exchanger performs heat exchange and a second air supplement refrigerant temperature in the air supplement pipeline after the air supplement heat exchanger performs the heat exchange are obtained.

Optionally, the air conditioner further includes a first sensor 121 disposed on a pipeline segment in front of the air supplement heat exchanger on the air supplement pipeline and used for obtaining the first air supplement refrigerant temperature in the air supplement pipeline before the air supplement heat exchanger performs the heat exchange; and a second sensor 122 disposed on a pipeline segment behind the air supplement heat exchanger on the air supplement pipeline and used for obtaining the second air supplement refrigerant temperature in the air supplement pipeline after the air supplement heat exchanger performs the heat exchange. The air conditioner further includes a controller 13 for determining an open/closed state of the air supplement control valve 14 based on the first air supplement refrigerant temperature and the second air supplement refrigerant temperature when the current superheat degree of the multi-split air conditioner reaches the set target superheat degree.

S603: an absolute value of a difference between the first air supplement refrigerant temperature and the second air supplement refrigerant temperature is calculated.

Optionally, the first air supplement refrigerant temperature can be a refrigerant temperature in the air supplement pipeline before the air supplement heat exchanger performs the heat exchange, and the second air supplement refrigerant temperature can be a refrigerant temperature in the air supplement pipeline after the air supplement heat exchanger performs the heat exchange. The absolute value of the difference between the first air supplement refrigerant temperature and the second air supplement refrigerant temperature is the superheat degree of the air supplement pipeline.

S604, when the absolute value of the difference is greater than a preset threshold range, the air supplement control valve 14 is controlled to be in an open state.

Optionally, when the absolute value of the difference between the first air supplement refrigerant temperature in the air supplement pipeline before the air supplement heat exchanger performs the heat exchange and the second air supplement refrigerant temperature in the air supplement pipeline after the air supplement heat exchanger performs the heat exchange is greater than a preset threshold range, it is indicated that the superheat degree is relatively high, the refrigerant circulation pipeline needs to be supplemented the air, and the controller 13 controls the air supplement control valve 14 to be opened.

Figure 7:
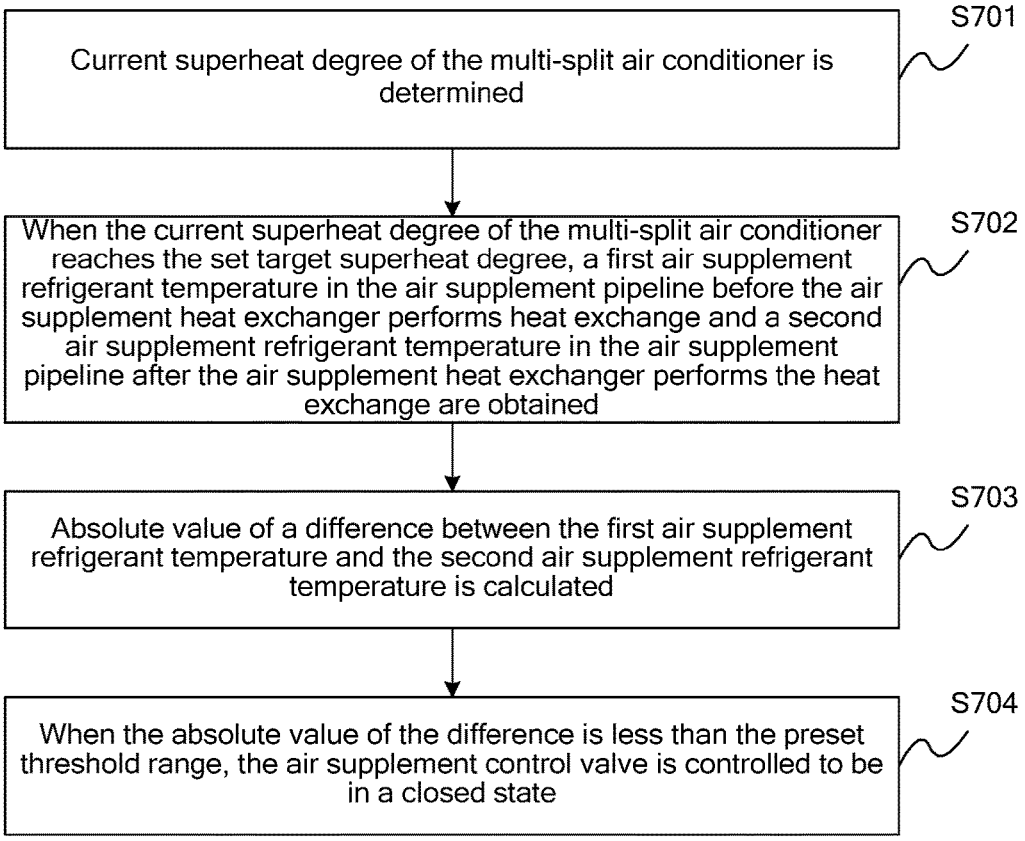
FIG. 7 is a flowchart illustrating a control method of an air conditioner according to an embodiment of the present disclosure.

FIG. 7 is a flowchart illustrating a control method of an air conditioner according to another exemplary embodiment of the present disclosure.

As shown in FIG. 7, the present disclosure further provides a control method of the air conditioner. The control method can also correlate a control of an air supplement control valve 14 of each refrigerant flow branch of a multi-split air conditioner 1, and regulate a superheat degree by controlling an opening degree of each air supplement control valve 14, and thus a heat exchange performance is improved and a heat exchange capability of the multi-split air conditioner 1 is maximized. Specifically, the control method mainly includes the following steps.

S701, a current superheat degree of the multi-split air conditioner 1 is determined.

Optionally, the superheat degree refers to a difference between a superheat temperature and a saturation temperature of the refrigerant at a same evaporation pressure in a refrigeration cycle. The multi-split air conditioner 1 includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve 14, wherein two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve 14 is used for controlling the flow rate of the refrigerant supplementing the air to the compressor.

Optionally, temperature sensors can be provided at two ends of the pipelines in the multi-split air conditioner 1 to detect temperatures at two ends of the pipelines, and thus the current superheat degree of the multi-split air conditioner 1 is obtained.

S702, when the current superheat degree of the multi-split air conditioner reaches the set target superheat degree, a first air supplement refrigerant temperature in the air supplement pipeline before the air supplement heat exchanger performs heat exchange and a second air supplement refrigerant temperature in the air supplement pipeline after the air supplement heat exchanger performs the heat exchange are obtained.

Optionally, the air conditioner further includes a first sensor 121 disposed on a pipeline segment in front of the air supplement heat exchanger on the air supplement pipeline and used for obtaining the first air supplement refrigerant temperature in the air supplement pipeline before the air supplement heat exchanger performs the heat exchange; and a second sensor 122 disposed on a pipeline segment behind the air supplement heat exchanger on the air supplement pipeline and used for obtaining the second air supplement refrigerant temperature in the air supplement pipeline after the air supplement heat exchanger performs the heat exchange. The air conditioner further includes a controller 13 for determining an open/closed state of the air supplement control valve 14 based on the first air supplement refrigerant temperature and the second air supplement refrigerant temperature when the current superheat degree of the multi-split air conditioner reaches the set target superheat degree.

S703: an absolute value of a difference between the first air supplement refrigerant temperature and the second air supplement refrigerant temperature is calculated.

Optionally, the first air supplement refrigerant temperature can be a refrigerant temperature in the air supplement pipeline before the air supplement heat exchanger performs the heat exchange, and the second air supplement refrigerant temperature can be a refrigerant temperature in the air supplement pipeline after the air supplement heat exchanger performs the heat exchange. The absolute value of the difference between the first air supplement refrigerant temperature and the second air supplement refrigerant temperature is the superheat degree of the air supplement pipeline.

S704: when the absolute value of the difference is less than the preset threshold range, the air supplement control valve is controlled to be in a closed state.

Optionally, when the absolute value of the difference between the first air supplement refrigerant temperature in the air supplement pipeline before the air supplement heat exchanger performs the heat exchange and the second air supplement refrigerant temperature in the air supplement pipeline after the air supplement heat exchanger performs the heat exchange is less than the preset threshold range, it is indicated that the superheat degree is relatively low, the refrigerant circulation pipeline does not need to be supplemented the air, and the controller 13 controls the air supplement control valve 14 to be closed.

Figure 8:
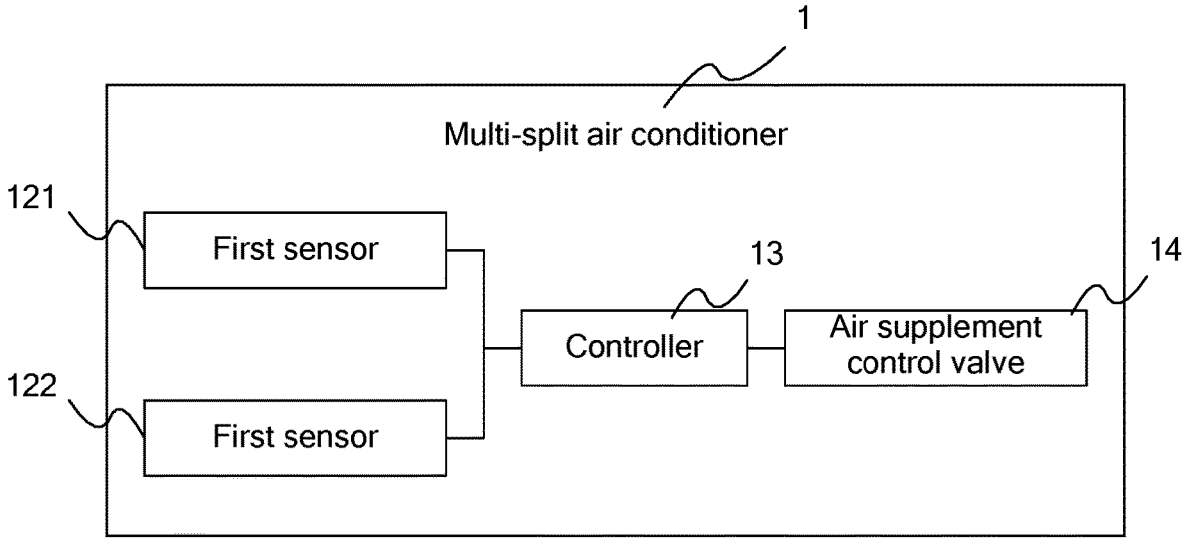
FIG. 8 is an overall structural schematic diagram illustrating an air conditioner according to an embodiment of the present disclosure.

FIG. 8 is an overall structural schematic diagram illustrating an air conditioner 1 according to an embodiment of the present disclosure.

As shown in FIG. 8, the present disclosure further provides an air conditioner 1 applied to perform the control steps of the embodiments corresponding to FIG. 1 described above. Specifically, the multi-split air conditioner 1 includes a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly includes an air supplement pipeline, an air supplement heat exchanger and an air supplement control valve 14, two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve 14 is used for controlling the flow rate of the refrigerant supplementing the air to the compressor; and the multi-split air conditioner 1 further includes a controller 13, used for:

determining a current superheat degree of the multi-split air conditioner 1;

when the current superheat degree of the multi-split air conditioner deviates from a set target superheat degree, controlling and regulating the flow rate of the refrigerant flowing through the branch control valve, so that the current superheat degree reaches the set target superheat degree; and controlling and regulating the flow rate of the refrigerant flowing through the air supplement control valve 14 according to the flow rate of the refrigerant flowing through each of branch control valves.

Optionally, temperature sensors can be provided at two ends of the pipelines in the multi-split air conditioner 1 to detect temperatures at two ends of the pipelines, and thus the current superheat degree of the multi-split air conditioner 1 is obtained.

Optionally, the air conditioner is provided with a controller 13, and the target superheat degree can be preset. The target superheat degree is not limited here, and the target superheat degree may be one degree. When the current superheat degree measured by the multi-split air conditioner 1 is greater than or less than one degree, the controller 13 can control and regulate the flow rate of the refrigerant flowing through the branch control valve. By changing the flow rate of the refrigerant flowing through each branch, the temperatures at two ends of the pipelines are regulated, so that the current superheat degree is regulated to reach the set target superheat degree.

Optionally, the multi-split air conditioner 1 is provided with the controller 13 that can be used for calculating the sum of the flow rate of the refrigerant flowing through each of the branch control valves, and regulating the control of the air supplement control valve 14 on the flow rate of the refrigerant according to the flow rate of the refrigerant flowing through each of the branch control valves. When the sum of the flow rate of the refrigerant flowing through each of the branch control valves is less than a preset parameter of the flow rate of the refrigerant, the controller 13 controls the air supplement control valve 14 to be opened; and when the sum of the flow rate of the refrigerant flowing through each of the branch control valves is greater than or equal to the preset parameter of the flow rate of the refrigerant, the controller 13 controls the air supplement control valve 14 to be closed.

Optionally, the multi-split air conditioner 1 is provided with the controller 13 that can control the flow opening degree of the air supplement control valve 14 according to the negative value of the sum of the flow rate of the refrigerant flowing through each of the branch control valves. When the sum of the flow rate of the refrigerant flowing through each of the branch control valves is less than the preset parameter of the flow rate of the refrigerant, the controller 13 controls the air supplement control valve 14 to be opened; and when the sum of the flow rate of the refrigerant flowing through each of the branch control valves is greater than or equal to the preset parameter of the flow rate of the refrigerant, the controller 13 controls the air supplement control valve 14 to be closed.

Optionally, the multi-split air conditioner 1 can also be provided with a controller 13 that can directly connect to the control valve on each branch and can directly control the flow rate of the refrigerant flowing through each of the branch control valves. When the current superheat degree of the multi-split air conditioner 1 is greater than or equal to the target superheat degree, the controller 13 can directly control to increase the flow rate of the refrigerant flowing through one of the branch control valves.

Optionally, the multi-split air conditioner 1 can also be provided with the controller 13 that can directly connect to the control valve on each branch. When the current superheat degree of the multi-split air conditioner 1 is greater than or equal to the target superheat degree, the controller 13 can directly control to increase the flow rate of the refrigerant flowing through more than one of the branch control valves, the present disclose does not limit the branch control valves, and the branch control valves are connected in parallel, which is equivalent to a shunt effect of the flow rate of the refrigerant.

Optionally, the multi-split air conditioner 1 can also be provided with a controller 13 that can directly connect to the control valve on each branch and can directly control the flow rate of the refrigerant flowing through each of the branch control valves. When the current superheat degree of the multi-split air conditioner 1 is less than the target superheat degree, the controller 13 can directly control to reduce the flow rate of the refrigerant flowing through one of the branch control valves.

Optionally, the multi-split air conditioner 1 can also be provided with the controller 13 that can directly connect to the control valve on each branch. When the current superheat degree of the multi-split air conditioner 1 is less than the target superheat degree, the controller 13 can directly control to increase the flow rate of the refrigerant flowing through more than one of the branch control valves, the present disclose does not limit the branch control valves, and the branch control valves are connected in parallel, which is equivalent to a shunt effect of the flow rate of the refrigerant.

Optionally, the air conditioner further includes a first sensor 121 disposed on a pipeline segment in front of the air supplement heat exchanger on the air supplement pipeline and used for obtaining the first air supplement refrigerant temperature in the air supplement pipeline before the air supplement heat exchanger performs the heat exchange; and a second sensor 122 disposed on a pipeline segment behind the air supplement heat exchanger on the air supplement pipeline and used for obtaining the second air supplement refrigerant temperature in the air supplement pipeline after the air supplement heat exchanger performs the heat exchange. The air conditioner further includes a controller 13 for determining an open/closed state of the air supplement control valve 14 based on the first air supplement refrigerant temperature and the second air supplement refrigerant temperature when the current superheat degree of the multi-split air conditioner reaches the set target superheat degree.

Optionally, the first air supplement refrigerant temperature can be a refrigerant temperature in the air supplement pipeline before the air supplement heat exchanger performs the heat exchange, and the second air supplement refrigerant temperature can be a refrigerant temperature in the air supplement pipeline after the air supplement heat exchanger performs the heat exchange. An absolute value of a difference between the first air supplement refrigerant temperature and the second air supplement refrigerant temperature is the superheat degree of the air supplement pipeline.

Optionally, when the absolute value of the difference between the first air supplement refrigerant temperature in the air supplement pipeline before the air supplement heat exchanger performs the heat exchange and the second air supplement refrigerant temperature in the air supplement pipeline after the air supplement heat exchanger performs the heat exchange is greater than a preset threshold range, it is indicated that the superheat degree is relatively high, the refrigerant circulation pipeline needs to be supplemented the air, and the controller 13 controls the air supplement control valve 14 to be opened.

Optionally, when the absolute value of the difference between the first air supplement refrigerant temperature in the air supplement pipeline before the air supplement heat exchanger performs the heat exchange and the second air supplement refrigerant temperature in the air supplement pipeline after the air supplement heat exchanger performs the heat exchange is less than the preset threshold range, it is indicated that the superheat degree is relatively low, the refrigerant circulation pipeline does not need to be supplemented the air, and the controller 13 controls the air supplement control valve 14 to be closed.

According to the embodiments of the present disclosure, the control of air supplement control valve 14 on each refrigerant flow branch in the multi-split air conditioner 1 can be correlated with each other, the superheat degree is regulated by controlling the opening degree of each of the air supplement control valves 14, thereby improving the heat exchange performance, and maximizing the heat exchange capability of the multi-split air conditioner 1.

In an embodiment of the present disclosure, there is provided a computer readable storage medium storing computer executable instructions, the computer executable instructions are configured to execute the above-mentioned control methods of the multi-split air conditioner.

In an embodiment of the present disclosure, there is provided a computer program product including a computer program stored on a computer readable storage medium, the computer program includes program instructions, and when the program instructions are executed by a computer, the computer performs the above-mentioned control methods of the multi-split air conditioner.

The above computer readable storage medium can be a transitory computer readable storage medium or a non-transitory computer readable storage medium.

Figure 9:
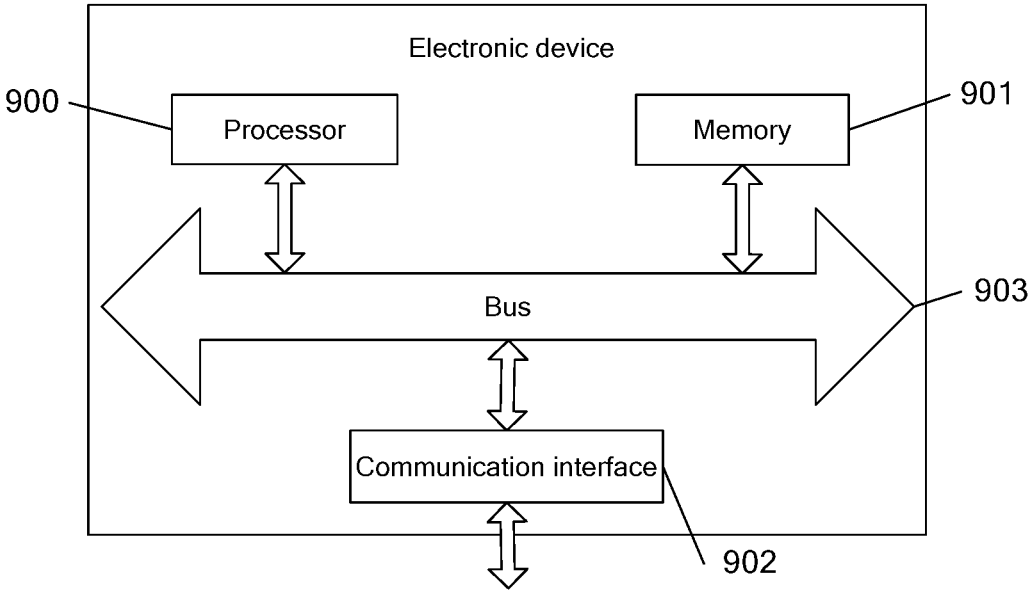
FIG. 9 is a schematic structural diagram illustrating an electronic device according to an embodiment of the present disclosure.

An embodiment of the present disclosure provides an electronic device, the structure of which is shown in FIG. 9. The electronic device includes:

at least one processor 900, taking one processor 900 as an example in FIG. 9; a memory 901; and further includes a communication interface 902 and a bus 903. The processor 900, the communication interface 902, and the memory 901 may communicate with each other through the bus 903. The communication interface 902 may be used for information transmission. The processor 900 may call logical instructions in the memory 901 to execute the methods in the above embodiments.

In addition, logic instructions in the above-mentioned memory 901 may be implemented in the form of software functional units and may be stored in a computer readable storage medium when sold or used as an independent product.

As a computer readable storage medium, the memory 901 may be configured to store a software program and a computer executable program, such as a program instruction/module corresponding to the methods in the embodiments of the present disclosure. The processor 900 executes functional applications and data processing by running the software program, instruction, and module that are stored in the memory 901, thereby implementing the methods in the method embodiments mentioned above.

The memory 901 may include a program storage area and a data storage area. The program storage area may store an operating system and an application program required by at least one function. The data storage area may store data created according to use of the terminal, and the like. In addition. In addition, the memory 901 may include a high speed random access memory, and may also include a non-volatile memory.

The technical solutions of the embodiments of the present disclosure may be embodied in the form of a software product, the computer software product is stored in a storage medium and includes one or more instructions to enable a computer device (may be a personal computer, a server, or a network device, etc.) to perform all or part of the steps of the methods described in the embodiments of the present disclosure. The above-mentioned storage medium may be a non-transitory storage medium, including a U disk, a removable hard disk, a read-only memory (ROM), a random access memory (RAM), a magnetic disk, an optical disk and other media that may store program codes, or may be a transitory storage medium.

The above description and accompanying drawings fully illustrate the embodiments of the present disclosure to enable those skilled in the art to practice them. Other embodiments may include structural, logical, electrical, procedural and other changes. The embodiments represent only possible variations. Individual components and functions are optional unless explicitly required, and the sequence of operations may vary. Parts and features of some embodiments may be included in or substituted for parts and features of other embodiments. The scope of the embodiments of the present disclosure includes the full scope of the claims, as well as all available equivalents of the claims. When used in the present application, although terms "first", "second", etc. may be used in the present application to describe various elements, these elements should not be limited by these terms. These terms are only used to distinguish one element from another. For example, without changing the meaning of the description, a first element may be called a second element, and similarly, the second element may be called the first element as long as all occurrences of the "first element" are renamed consistently and all occurrences of the "second element" are renamed consistently. The first element and the second element are both elements, but may not be the same element. Moreover, the words used in present application are only used to describe the embodiments and are not used to limit the claims. As used in the description of the embodiments and the claims, singular forms "a", "an" and "the" are intended to include plural forms as well unless the context clearly indicates. Similarly, as the term "and/or" used in the present application refers to any and all possible combinations including one or more associated listings. In addition, when used in present application, the term "comprise" and variations thereof "comprises" and/or "comprising" and the like refer to the presence of stated features, entireties, steps, operations, elements, and/or components, but do not exclude the presence or addition of one or more other features, entireties, steps, operations, elements, components, and/or groups thereof. Without further restrictions, the element defined by the statement "include a . . . " does not exclude the presence of another identical element in the process, method or device that includes the element. In this document, each embodiment may highlight its differences from other embodiments, and same or similar parts between various embodiments may be referred to each other. For the method, the product and the like disclosed in the embodiments, if it corresponds to the method part disclosed in the embodiments, relevant parts may refer to the description in the method part.

Those skilled in the art may recognize that the elements and algorithm steps of the examples described in the embodiments disclosed herein may be implemented by electronic hardware, or a combination of computer software and electronic hardware. Whether these functions are implemented by hardware or software depends on the specific application and design constraints of the technical solutions. Those skilled may use different methods to implement the described functions for each specific application, but such implementation should not be considered beyond the scope of the embodiments of the present disclosure. Those skilled may clearly understand that for convenience and conciseness of description, the specific work processes of the above-mentioned systems, devices and units may refer to corresponding processes in the above-mentioned method embodiments and will not be repeated herein.

In the embodiments disclosed herein, the disclosed methods and products (including but not limited to devices, equipment, etc.) may be implemented in other ways. For example, the device embodiments described above are only schematic. For example, the division of the units may be only a logical function division, and there may be other division manners in actual implementation. For example, a plurality of units or components may be combined or integrated into another system, or some features may be ignored or not implemented. In addition, the mutual coupling, direct coupling or communication connection shown or discussed may be indirect coupling or communication connection through some interfaces, devices or units, and may be in electrical, mechanical or other forms. The units described as separate components may or may not be physically separated, and the components displayed as units may or may not be physical units, i.e., may be located in one place or may be distributed to a plurality of network units. Some or all of the units may be selected to implement the embodiments according to actual needs. In addition, each functional unit in the embodiments of the present disclosure may be integrated in one processing unit, or each unit may exist separately physically, or two or more units may be integrated in one unit.

The flowcharts and block diagrams in the drawings show the architecture, functions and operations of possible implementations of systems, methods and computer program products according to the embodiments of the present disclosure. In this regard, each block in the flowcharts or block diagrams may represent a module, program segment, or portion of code that includes one or more executable instructions for implementing specified logical functions. In some alternative implementations, the functions noted in the blocks may also occur in an order different from that noted in the drawings. For example, two consecutive blocks may actually be executed substantially in parallel, and they may sometimes be executed in a reverse order, depending on the function involved. In the description corresponding to the flowcharts and block diagrams in the drawings, operations or steps corresponding to different blocks may also occur in orders different from that disclosed in the description, and sometimes there is no specific order between different operations or steps. For example, two consecutive operations or steps may actually be executed substantially in parallel, and they may sometimes be executed in a reverse order, depending on the function involved. Each block in the block diagrams and/or flowcharts, and combinations of blocks in the block diagrams and/or flowcharts, may be implemented by special hardware-based systems that perform specified functions or actions, or may be implemented by combinations of special hardware and computer instructions.

What is claimed is:

1. A control method of a multi-split air conditioner, wherein the multi-split air conditioner comprises a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly comprises an air supplement pipeline, an air supplement heat exchanger and an air supplement control valve, two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve is used for controlling the flow rate of the refrigerant supplementing the air to the compressor; wherein the control method comprises:

determining a current superheat degree of the multi-split air conditioner;

when the current superheat degree of the multi-split air conditioner deviates from a set target superheat degree, controlling and regulating the flow rate of the refrigerant flowing through one or more of the branch control valves, so that the current superheat degree reaches the set target superheat degree; and controlling and regulating the flow rate of the refrigerant flowing through the air supplement control valve according to the flow rate of the refrigerant flowing through each of branch control valves.

2. The control method according to claim 1, wherein the controlling and regulating the flow rate of the refrigerant of the air supplement control valve according to the flow rate of the refrigerant flowing through each of the branch control valves comprises:

calculating a sum of the flow rate of the refrigerant flowing through each of the branch control valves; and controlling the air supplement control valve to regulate a flow opening degree based on a negative value of the sum of the flow rate of the refrigerant.

3. The control method according to claim 1, wherein the current superheat degree of the multi-split air conditioner deviates from a set target superheat degree, controlling and regulating the flow rate of the refrigerant flowing through one or more of the branch control valves comprises:

when the current superheat degree of the multi-split air conditioner is greater than or equal to the target superheat degree, controlling to increase the flow rate of the refrigerant flowing through one or more of the branch control valves; and when the current superheat degree of the multi-split air conditioner is less than the target superheat degree, controlling to reduce the flow rate of the refrigerant flowing through one or more of the branch control valves.

4. The control method according to claim 1, wherein the control method further comprises:

when the current superheat degree of the multi-split air conditioner reaches the set target superheat degree, obtaining a first air supplement refrigerant temperature in the air supplement pipeline before the air supplement heat exchanger performs heat exchange and a second air supplement refrigerant temperature in the air supplement pipeline after the air supplement heat exchanger performs the heat exchange; and determining an open/closed state of the air supplement control valve based on the first air supplement refrigerant temperature and the second air supplement refrigerant temperature.

5. The control method according to claim 4, wherein the determining an open/closed state of the air supplement control valve based on the first air supplement refrigerant temperature and the second air supplement refrigerant temperature comprises:

calculating an absolute value of a difference between the first air supplement refrigerant temperature and the second air supplement refrigerant temperature;

when the absolute value of the difference is greater than a preset threshold range, controlling the air supplement control valve to be in an open state; and when the absolute value of the difference is less than the preset threshold range, controlling the air supplement control valve to be in a closed state.

6. A multi-split air conditioner, wherein the multi-split air conditioner comprises a plurality of outdoor heat exchangers connected in parallel to a refrigerant main circulation passage, wherein a parallel branch in which each of the plurality of outdoor heat exchangers is located is provided with a branch control valve capable of controlling a flow rate of refrigerant flowing through the parallel branch; and an air supplement pipe assembly used for conveying a part of refrigerant in the refrigerant main circulation passage to an air supplement port of a compressor to supplement air to the compressor, wherein the air supplement pipe assembly comprises an air supplement pipeline, an air supplement heat exchanger and an air supplement control valve, two ends of the air supplement pipeline are respectively connected to the refrigerant main circulation passage and the air supplement port of the compressor, two heat exchange chambers of the air supplement heat exchanger are respectively connected in series to the refrigerant main circulation passage and the air supplement pipeline, and the air supplement control valve is used for controlling the flow rate of the refrigerant supplementing the air to the compressor; and the multi-split air conditioner further comprises a controller, used for:

determining a current superheat degree of the multi-split air conditioner;

when the current superheat degree of the multi-split air conditioner deviates from a set target superheat degree, controlling and regulating the flow rate of the refrigerant flowing through one or more of the branch control valves, so that the current superheat degree reaches the set target superheat degree; and controlling and regulating the flow rate of the refrigerant flowing through the air supplement control valve according to the flow rate of the refrigerant flowing through each of branch control valves.

7. The multi-split air conditioner according to claim 6, wherein the controller is used for: calculating a sum of the flow rate of the refrigerant flowing through each of the branch control valves; and controlling the air supplement control valve to regulate a flow opening degree based on a negative value of the sum of the flow rate of the refrigerant.

8. The multi-split air conditioner according to claim 6, wherein the controller is used for:

when the current superheat degree of the multi-split air conditioner is greater than or equal to the target superheat degree, controlling to increase the flow rate of the refrigerant flowing through one or more of the branch control valves; and when the current superheat degree of the multi-split air conditioner is less than the target superheat degree, controlling to reduce the flow rate of the refrigerant flowing through one or more of the branch control valves.

9. The multi-split air conditioner according to claim 6, wherein the multi-split air conditioner further comprises:

a first sensor disposed on a pipeline segment in front of the air supplement heat exchanger on the air supplement pipeline and used for obtaining a first air supplement refrigerant temperature in the air supplement pipeline before the air supplement heat exchanger performs heat exchange; and a second sensor disposed on a pipeline segment behind the air supplement heat exchanger of the air supplement pipeline and used for obtaining a second air supplement refrigerant temperature in the air supplement pipeline after the air supplement heat exchanger performs the heat exchange;

wherein the controller is further used for:

when the current superheat degree of the multi-split air conditioner reaches the set target superheat degree, determining an open/closed state of the air supplement control valve based on the first air supplement refrigerant temperature and the second air supplement refrigerant temperature.

10. The multi-split air conditioner according to claim 9, wherein the controller is further used for:

calculating an absolute value of a difference between the first air supplement refrigerant temperature and the second air supplement refrigerant temperature;

when the absolute value of the difference is greater than a preset threshold range, controlling the air supplement control valve to be in an open state; and when the absolute value of the difference is less than the preset threshold range, controlling the air supplement control valve to be in a closed state.

* * * * *